United States Patent [19]

Sollinger

[11] Patent Number: 4,773,351

[45] Date of Patent: Sep. 27, 1988

[54] DOCTOR BLADE MOUNTING

[75] Inventor: Hans-Peter Sollinger, Heidenheim, Fed. Rep. of Germany

[73] Assignee: J. M. Voith GmbH, Heidenheim, Fed. Rep. of Germany

[21] Appl. No.: 902,017

[22] Filed: Aug. 29, 1986

Related U.S. Application Data

[63] Continuation of Ser. No. 593,605, Mar. 26, 1984, abandoned.

[30] Foreign Application Priority Data

Mar. 26, 1983 [DE] Fed. Rep. of Germany ..... 3311081

[51] Int. Cl.[4] ..... B05C 11/04

[52] U.S. Cl. ..... 118/119; 118/118; 15/256.5

[58] Field of Search ..... 15/256.51, 256.52, 245, 15/256.15; 118/118, 119, 126

[56] References Cited

U.S. PATENT DOCUMENTS

| | | | |
|---|---|---|---|
| 3,187,366 | 6/1965 | Fant | 15/245 X |
| 3,559,229 | 2/1971 | De Noyer | 15/256.51 |
| 3,817,208 | 6/1974 | Barnscheidt et al. | 118/119 |
| 4,367,691 | 1/1983 | Bergs | 118/119 |
| 4,375,202 | 3/1983 | Miller | 118/119 X |

*Primary Examiner*—John P. McIntosh

*Attorney, Agent, or Firm*—Grimes & Battersby

[57] ABSTRACT

A doctor blade mounting is provided for use in association with a running web of sheet material, such as, for example, paper. The doctor blade mounting includes a doctor blade column retained in a blade bed which is formed of an elastomeric material. A leaf spring is provided for providing tension between the doctor blade column and the running web and is secured to the blade bed by a guide shaft adapted to receive an end of the leaf spring. The leaf spring is secured in the guide shaft by retaining means, i.e., catches, cams or flanges. Due to the creation of a flexible portion within the blade bed, the leaf spring can be unlocked after removal of the doctor blade column.

18 Claims, 1 Drawing Sheet

DOCTOR BLADE MOUNTING

This application is a continuation, of application Ser. No. 593,605, filed Mar. 26, 1984, now abandoned.

BACKGROUND OF THE INVENTION

The present invention relates generally to a doctor blade mounting which is adapted to be used in association with a running web such as, for example, a running web of paper. The doctor blade mounting of the present invention includes a blade bed formed from an elastomeric material which is adapted to receive and retain a doctor blade column, preferably a cylindrical doctor blade column, by the spring forces which are exerted by the elastomeric material.

The doctor blade mounting is maintained in position relative to the running web by means of a leaf spring which is adapted to be retained and interlocked in a guide shaft contained in the blade bed. The blade bed contains at least one groove opening which opens into and extends essentially parallel to the doctor blade column. The midline or center of the at least one groove opening is located approximately at the level of the center axis of the doctor blade column when viewed from the inlet end of the guide shaft for the leaf spring. The doctor blade column is transposed substantially laterally from the plane of the guide shaft for the leaf spring. The guide shaft for the leaf spring extends sufficiently far into the blade bed and at a sufficient distance from the groove opening of the blade bed located nearest to the inner end of the guide shaft that a flexible segment is created within the blade bed. The flexible segment extends axially through the entire blade bed between the at least one groove opening and the guide shaft.

Catches, cams, flanges or other retaining devices are provided on the end of the leaf spring which is adapted to be attached and secured to the blade bed. The retaining devices interlock with an extension groove contained in the blade bed and permit interlocking of the leaf spring and the blade bed. The extension groove is positioned on the side of the guide shaft which is adjacent to the doctor blade column and it extends parallel to the doctor blade column essentially through the entire blade bed.

A doctor blade mounting of somewhat similar construction was described in German Patent No. DE-PS 20 26 334. The doctor blade mounting assembly described in that earlier patent was arranged in such a manner that its plane passed through the guide shaft for the leaf spring and intercepted the doctor blade column at its approximate midpoint. The blade bed had a chamfered surface which rolled along on a supporting slat. In such an assembly, it was not possible for the blade bed to shift relative to the leaf spring, at least not to such an extent which might affect the performance of the equipment during operation. Further, there was no apparent provision for a groove opening to the doctor blade column which would pass through the axial extension of the blade bed. Instead, rinse water was supplied to the doctor blade column solely through an enlarged hole.

Against the foregoing background, the object of the present invention is to provide a doctor blade mounting which in relatively easy to manufacture and operate and which is safe to use.

SUMMARY OF THE INVENTION

The accomplishment of the foregoing object is achieved by providing a doctor blade mounting which includes a blade bed formed of an elastomeric material, particularly a synthetic elastomeric material, in which is held a doctor blade column, preferably a cylindrical doctor blade column, by the spring forces generated by the elastomeric material. The blade bed and doctor blade column are retained in position relative to a running web of material such, as for example, paper, by means of a leaf spring which is retained and secured within a guide shaft contained within the blade bed. At least one groove opening is provided in the blade bed which opens into and extends substantially parallel to the doctor blade column. The midline of the at least one groove opening into the doctor blade column is located approximately along the level of the center axis of the doctor blade column as viewed from the inlet end of the guide shaft for the leaf spring. The doctor blade column is transposed substantially laterally from the plane of the guide shaft for the leaf spring. The guide shaft for the leaf spring extends sufficiently into the blade bed and at such a distance from the at least one groove opening to create a flexible portion or segment which extends axially through the entire blade bed between the at least one groove opening and the guide shaft. Catches, cams, flanges or other locking or retaining devices are provided on the end of the leaf spring which is adapted to be inserted and retained within the guide shaft of the blade bed. These catches, cams, flanges or other locking or retaining devices are adapted to be engaged by an extension groove located on the side of the guide shaft facing the doctor blade column and which extends parallel to the doctor blade column substantially through the entire blade bed.

The blade bed preferably has a Shore scleroscope hardness of between about 60 and about 100 and, most preferably, between about 85 and about 100. In a further preferred embodiment, the retaining device on the leaf spring comprises a catch which constitutes a protrusion which is stamped out of the leaf springs. Alternatively, the catch may be a strip which is welded, soldered, cemented or otherwise affixed or bonded to the leaf spring.

In an alternative embodiment, the doctor blade mounting includes a blade bed which is fabricated from an elastomeric material, preferably a synthetic elastomeric material. The blade bed is adapted to receive and retain a cylindrical doctor blade column due to the spring forces exerted by the elastomeric material. The blade bed is retained in position relative to the running web by a leaf spring which is secured to the blade bed by insertion of an end of the leaf spring within a guide shaft within the blade bed. At least one groove opening is provided in the blade bed which opens into and extends substantially parallel to the doctor blade column. The doctor blade column is considerably shifted to the side of the plane of the guide shaft. Further, the at least one groove opening is provided in the blade bed in the region of or in front of the midline of the doctor blade column when viewed from the inlet end of the guide shaft. Catches, cams, flanges or other retaining devices are provided at the end of the leaf spring which is inserted into the guide shaft in the blade bed. These catches, cams, flanges or other retaining devices are adapted to interlock with an extension groove located in the blade bed on the side of the guide shaft for the leaf spring facing the doctor blade column. The guide shaft for the leaf spring extends at a distance from the at least one groove opening located on the doctor blade column nearest to the inlet end of the guide shaft such that a flexible portion or segment is created which extends substantially parallel to the doctor blade column and over the entire length of the blade bed between the groove opening and the guide shaft.

The blade bed of the mounting of this alternative embodiment preferably has a Shore scleroscope hardness of between about 60 and about 100 and, most preferably, of between about 85 and about 100. Further, in this alternative embodiment, the retaining device at the end of the leaf spring may comprise a catch which is made up of a protrusion which is stamped out of the leaf spring. Alternatively, the catch can be made up of a strip which is welded, soldered, cemented or otherwise affixed or bonded to the leaf spring.

BRIEF DESCRIPTION OF THE DRAWINGS

The foregoing and still other objects and advantages of the present invention will be more apparent from the following detailed explanation of the preferred embodiments of the invention in connection with the accompanying drawings, wherein.

DETAILED DESCRIPTION OF THE PREFERRED EMBODIMENTS

Figure 1:
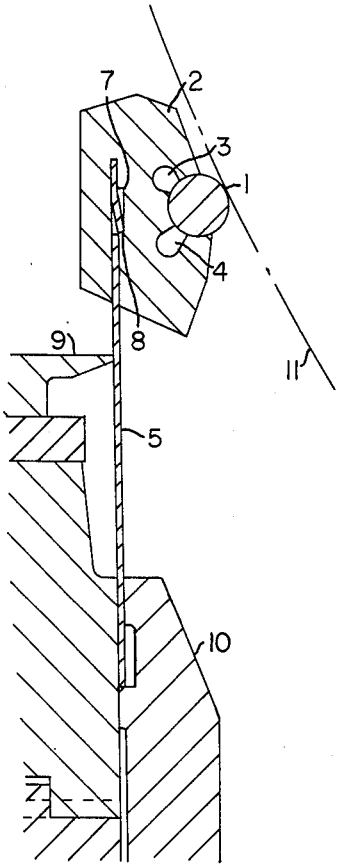
FIG. 1 illustrates, in sectional view, the doctor blade mounting of the present invention as used in conjunction with a running web route.

FIG. 1 illustrates the doctor blade mounting of the present invention. As illustrated therein, a blade bed 2 is provided which supports a doctor blade column or roll 1 illustrated as a cylindrical doctor blade. The blade bed 2 is formed from an elastomeric material, preferably a synthetic elastomeric material. The Shore scleroscope hardness of the blade bed 2 should be between about 60 and about 100 and, preferably, between about 85 and about 100. The doctor blade bed 2 and the attached doctor blade column 1 are adapted to be positioned in association with and relative to a running web route 11, illustrated in FIG. 1 by dotted lines. The running web 11 may consist of virtually any type of sheet material, such as for example, a running web of paper. The running web route generally moves over an opposing roller (not shown) which is positioned parallel to the doctor blade column 1.

The blade bed 2 is secured in position relative to the running web 11 such that the doctor blade column 1 is positioned adjacent to the running web 11 by the use of a leaf spring 5 which is secured at one end of the blade bed 2 and at its opposite end to a machine frame by one or more pressure components 10. A thrust strip 9 is provided against the leaf spring for maintaining tension against the leaf spring 5 which, thereby, causes the blade bed 2 and the doctor blade column 1 to exert a predetermined amount of tension against the running web route 11. At least one and preferably at least two groove openings 3 and 4 are provided in the blade bed 2 and which open into a groove for retaining the doctor blade column 1. These groove openings 3 and 4 are adapted to carry cooling and lubrication fluids, preferably water, directly into the doctor blade column 1.

A guide shaft 6 is further provided in the blade bed 2, transposed laterally outside the cross-section of the doctor blade column 1. The guide shaft 6, as illustrated in FIGS. 1 and 2, is recessed in the blade bed 2 and is adapted to receive and retain one end of the leaf spring 5 therein.

Leaf spring 5 is formed from a relatively thin, spring steel. A preferred thickness for the leaf spring 5 is between about 0.3 and about 1.0 mm. Leaf spring 5 extends over the substantially the entire length of the doctor blade column, i.e., essentially over the length of the route of the running web. Retaining devices 8 and 8' (in FIG. 2) are provided at the end of the leaf spring 5 adapted to be received in and engage an extension groove 7 of the guide shaft 6 in the blade bed 2 for securing the leaf spring 5 to the blade bed 2. Retaining devices 8 and 8' may comprise catches, cams, flanges or other locking devices. In a preferred embodiment, the retaining device 8 and 8' comprises a protrusion which is stamped out of the leaf spring 5. Alternatively, retaining device 8 and 8' may comprise a retaining strip which is welded, soldered, cemented, adhesively bonded or otherwise affixed or secured to the end of the leaf spring 5.

Due to the resilient nature of the blade bed 2, i.e. it being formed from an elastomeric material having a Shore scleroscope hardness of between about 60 and about 100, and the positioning of the guide shaft 6 and the groove opening 3 (in FIGS. 1 and 2), a flexible portion or segment is created between the guide shaft 6 and the groove opening 3. Due to the prescribed Shore scleroscope hardnesses, the thickness of the flexible portion should generally be between about 3 and about 10 mm and, preferably, between about 3 and about 8 mm. The creation of this flexible portion permits easy removal of the doctor blade column 1 and the leaf spring 5 from the blade bed 2. After removal of the doctor blade column 1 from the blade bed 2, the leaf spring 5 can either be fastened to the blade bed 2 or removed therefrom. By bending the leaf spring 5, the blade bed 2 yields at the flexible portion and the retaining device 8 or 8' is released from and springs out of the extension groove 7.

Figure 2:
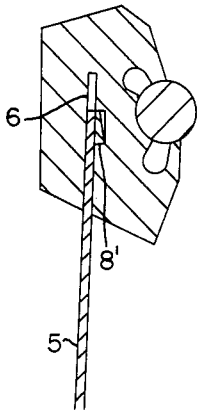
FIG. 2 illustrate, in sectional view, an alternative blade bed portion.

Due to the geometric conditions, the embodiments of FIGS. 1 and 2 are preferred embodiments.

Figure 3:
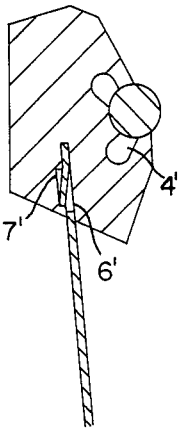
FIG. 3 illustrates, in sectional view, still another alternative blade bed portion.

In FIG. 3, the doctor blade mounting is arranged such that the flexible segment is positioned between the lowermost groove opening 4' and the guide shaft 6'. In this embodiment, the extension groove 7' of the guide shaft 6' is positioned on the side of the guide shaft 6' which is remote from the doctor blade column 1. Likewise, the retaining device 8' can be readily unlocked from the extension groove 7' after the doctor blade column 1 has been removed by bending the leaf spring 5, thereby releasing or securing the blade bed 2.

Wherefore I claim:

1. A doctor roll mounting for use in association with a running web having a leaf spring with a retaining device, said mounting including a roll bed for receiving a doctor roll therein, formed of an elastomeric material;

a groove for retaining said doctor roll by spring forces exerted by said elastomeric material;

a guide shaft having inlet and interior ends receiving and retaining one end of said leaf spring, said guide shaft being adapted to tension said doctor roll against said running web, wherein said guide shaft, when viewed from the inlet end, is spaced laterally from said groove for retaining said doctor roll, with the interior end of said guide shaft extending into said roll bed beyond a plane perpendicular to said guide shaft which contains said doctor roll;

at least one groove opening which opens into said groove for retaining said doctor roll and has a center line which extends substantially parallel to a center axis of said doctor roll, and wherein said doctor roll is located between said guide shaft and said running web, and wherein said guide shaft extends sufficiently into said roll bed and at such a distance relative to said at least one groove opening that a flexible portion is created between said at least one groove opening and said guide shaft and extends substantially axially through said roll bed; and an extension groove positioned on the side of said guide shaft facing said doctor roll for receiving the retaining device of said leaf spring.

2. The doctor roll mounting of claim 1, wherein the Shore scleroscope hardness of said roll bed is between about 60 and about 100.

3. The doctor roll mounting of claim 1, wherein the Shore scleroscope hardness of said roll bed is between about 85 and about 100.

4. The doctor roll mounting of claim 1, wherein the retaining device at the end of said leaf spring is a catch which is stamped out of said leaf spring.

5. The doctor roll mounting of claim 1, wherein the retaining device at the end of said leaf spring is a catch which is fabricated from a strip which is attached to said leaf spring.

6. The doctor roll mounting of claim 5, wherein the strip is attached to said leaf spring by bonding.

7. The doctor roll mounting of claim 1, wherein the thickness of said leaf spring is between about 0.3 and about 1.0 mm.

8. The doctor roll mounting of claim 1, wherein the thickness of said flexible portion is between about 3 and about 10 mm.

9. The doctor roll mounting of claim 1, wherein the thickness of said flexible portion is between about 3 and about 8 mm.

10. A doctor roll mounting for use in association with a running web having a leaf spring with a retaining device, said mounting including a roll bed for receiving a doctor roll therein, formed of an elastomeric material;

a groove for retaining said doctor roll therein by spring forces exerted by said elastomeric material;

a guide shaft having inlet and interior ends receiving and retaining one end of said leaf spring, said guide shaft being adapted to tension said doctor roll against said running web, wherein said guide shaft, when viewed from the inlet end, is spaced laterally from said groove for retaining said doctor roll; wherein said doctor roll is located between said guide shaft and said running web;

at least one groove opening which opens into said groove for retaining said doctor roll and has a center line which extends substantially parallel to a center axis of said doctor roll, wherein the center line of said at least one groove opening is positioned approximately equidistant or nearer the inlet end of said guide shaft than the center axis of said doctor roll is to the inlet and of said guide shaft, and wherein said guide shaft extends at a distance from said at least one groove opening such that a flexible portion is created between said at least one groove opening and said guide shaft and extends substantially axially through said roll bed; and an extension groove positioned on the side of said guide shaft opposite said doctor roll for receiving the retaining device of said leaf spring.

11. The doctor roll mounting of claim 10, wherein the Shore scleroscope hardness of said roll bed is between about 60 and about 100.

12. The doctor roll mounting of claim 10, wherein the Shore scleroscope hardness of said roll bed is between about 85 and about 100.

13. The doctor roll mounting of claim 10, wherein the retaining device at the end of said leaf spring is a catch which is stamped out of said leaf spring.

14. The doctor roll mounting of claim 10, wherein the retaining device at the end of said leaf spring is a catch which is fabricated from a strip which is attached to said leaf spring.

15. The doctor roll mounting of claim 14, wherein the strip is attached to said leaf spring by bonding.

16. The doctor roll mounting of claim 10, wherein the thickness of said leaf spring is between about 0.3 and about 1.0 mm.

17. The doctor roll mounting of claim 10, wherein the thickness of said flexible portion is between about 3 and about 10 mm.

18. The doctor roll mounting of claim 10, wherein the thickness of said flexible portion is between about 3 and about 8 mm.

* * * * *